United States Patent [19]

Hede

[11] 4,340,432

[45] Jul. 20, 1982

[54] METHOD OF MANUFACTURING STAINLESS FERRITIC-AUSTENITIC STEEL

[75] Inventor: Allan Hede, Surahammar, Sweden

[73] Assignee: ASEA Aktiebolag, Västerås, Sweden

[21] Appl. No.: 262,431

[22] Filed: May 11, 1981

[30] Foreign Application Priority Data

May 13, 1980 [SE] Sweden ..... 8003567

[51] Int. Cl.[3] ..... B22F 3/16

[52] U.S. Cl. ..... 148/11.5 P; 75/0.5 C; 75/200; 75/244; 75/246

[58] Field of Search ..... 148/11.5 P; 75/0.5 C, 75/244, 243, 245, 246, 200, 205

[56] References Cited

U.S. PATENT DOCUMENTS

| | | | |
|---|---|---|---|
| 3,522,020 | 7/1970 | Parikh | 75/243 |
| 3,598,567 | 8/1971 | Grant | 75/243 |
| 4,028,094 | 6/1977 | Reen et al. | 75/0.5 C |
| 4,139,377 | 2/1979 | Bergh et al. | 75/0.5 C |
| 4,240,831 | 12/1980 | Ro et al. | 75/0.5 C |

*Primary Examiner*—W. Stallard

*Attorney, Agent, or Firm*—Watson, Cole, Grindle & Watson

[57] ABSTRACT

A method of manufacturing stainless ferritic-austenitic steel having good corrosion properties, above all a good resistance to intercrystalline corrosion, a high yield strength and good hot-workability, which contains up to 0.10 percent of C, up to 4.0 percent of Si, up to 2.0 percent of Mn, from 20 to 30 percent of Cr, from 3 to 8 percent of Ni, from 1.0 to 6.0 percent of Mo, up to 0.5 percent of V and up to 4.0 percent of Cu, the remainder being iron and unavoidable impurities in unimportant amounts. The method includes the steps of preparing a melt of the steel with a nitrogen content higher than about 0.10 percent, preferably from about 0.15 to about 0.80 percent, and an austenite content not less than about 20 percent, preferably from about 20 percent to about 50 percent, gas atomizing said melt to form a powder, compacting said powder into a body, preferably employing an isostatic or semiisostatic compaction procedure, heat-treating said body at a temperature of from about 950° to about 1250° C., and cooling the heat-treated body in water, oil or air.

6 Claims, No Drawings

METHOD OF MANUFACTURING STAINLESS FERRITIC-AUSTENITIC STEEL

TECHNICAL FIELD

This invention relates to a method of manufacturing stainless ferritic-austenitic steel having good corrosion properties, above all a good resistance to intercrystalline corrosion, a high yield strength and a good hot-workability, and which contains up to 0.10 percent of C, up to 4.0 percent of Si, up to 2.0 percent of Mn, from 20 to 30 percent of Cr, from 3 to 8 percent of Ni, from 1 to 6 percent of Mo, up to 0.5 percent of V, and up to 4 percent of Cu, the remainder being iron and unavoidable impurities in unimportant amounts.

Throughout this specification, inclusive of the appended claims, the compositional percentages are by weight.

BACKGROUND ART

Up to now, when there has been a need for a steel having a high yield strength and a good corrosion resistance, for example parts of separating machines for separating sand from oil sand, ferritic-austenitic steel of type SIS (Swedish Industrial Standard) 2324 has primarily been used, this steel containing up to 0.10 percent of C, up to 1.0 percent of Si, up to 1.0 percent of Mn, from 24 to 27 percent of Cr, from 4.5 to 6.0 percent of Ni, from 1.3 to 1.8 percent of Mo and N normally occurring in amounts of about 0.05 percent, the balance being iron and unimportant quantities of unavoidable impurities.

After solution treatment and quenching, such a steel gives a yield strength of at least 440 Newtons per square millimeter ($N/mm^2$), an extension of at least 20 percent and an impact strength of at least 25 joules (J). The steel has good corrosion properties but may in certain cases be sensitive to intercrystalline corrosion.

For the aforementioned separating machine parts, which frequently are exposed to environments where there are risks of intercrystalline corrosion, a steel has already been developed (see British Patent Specification No. 1,461,654) which contains up to 0.06 percent of C, up to 1.5 percent of Si, up to 1.0 percent of Mn, from 22 to 26 percent of Cr, from 4 to 7 percent of Ni, from 2.5 to 4.0 percent of Mo, and from 0.05 to 0.20 percent of N, the balance being iron and unimportant quantities of unavoidable impurities. If a steel having a composition within these limits has been balanced so that the austenite content is from 30 to 55 percent, the steel is completely resistant to intercrystalline corrosion after solution treatment and quenching. The strength properties are the same as for the steel of type SIS 2324.

To attain good corrosion properties in special environments, such as environments containing sulfuric acid, attempts have been made to alloy steels of the above-mentioned types with copper. As an example of such steels there may be mentioned steels according to British Patent Specification No. 1,158,614. Good corrosion properties have been obtained, but it has not been possible successfully to utilize the steels for forging because of their great liability to cracking during the forging.

Attempts have also been made to improve the corrosion properties of the above-mentioned steels by increasing their Si, Cr and/or Mo contents. Even in these cases the forgeability has often deteriorated, so that it has not been possible to produce forgings because of crack problems. However, the biggest problem when increasing the content of any of these alloying elements in steels of the above-mentioned types is that the steels are rendered brittle with separation occurring primarily within regions which have built up higher concentrations of alloying elements because of segregation, thus making such alloying compositions useless in practice.

In order to improve the yield strength of the above-mentioned steels up to a level of at least 600 $N/mm^2$, various methods have been tried. Thus, in Swedish Patent Specification No. 365821, which discloses a steel containing up to 0.15 percent of C, up to 1 percent of Si, up to 1 percent of Mn, from 20 to 30 percent of Cr, from 4 to 10 percent of Ni, up to 2.5 percent of Mo and up to 0.20 percent of N, the balance being iron and unimportant quantities of unavoidable impurities, the steel preferably has an austenite content of at least 30 percent and, after solution treatment and quenching from 925° to 1125° C. in water, it has been aged at a temperature of from 400° to 500° C. A yield strength of at least 60 kiloponds/$mm^2$ may thus be obtained, the other properties being comparable with those of the steel of type SIS 2324. For the toughness to be acceptable, however, a uniform and fine-grained structure is required with a uniform distribution of austenite and with insignificant segregation. This latter condition has made it somewhat difficult to utilize the last-mentioned steel in practice. Furthermore, the steel has proved to be liable to crack during forging when the austenite content exceeds about 40 percent.

Swedish published patent applications Nos. 16555/71 and 5352/72 disclose other means for achieving a high yield strength. In the former the high yield strength is obtained by a high silicon content (>2 percent Si), and in the latter it is obtained by precipitation hardening with aluminum. Because of manufacturing problems, mainly the formation of cracks, these steels have not been capable of being utilized in practice either.

German Offenlegungsschrift No. 2032945 proposes to achieve a yield strength of at least 600 $N/mm^2$ by means of a steel which contains up to 0.12 percent of C, up to 1 percent of Si, up to 2 percent of Mn, from 20 to 30 percent of Cr, from 4.0 to 6.0 percent of Ni, from 1.5 to 2 percent of Mo and from 0.1 to 0.4 percent of N, the balance being iron and unimportant quantities of unavoidable impurities, and having an austenite content of from 20 to 60 percent. At nitrogen contents exceeding 0.20 percent and an austenite content exceeding 20 percent, this steel is likewise difficult to forge without cracks forming. The steel is furthermore difficult to work. Sawing is a particularly difficult problem. The properties may become non-uniform because of segregations.

The present invention aims to provide a method of manufacturing stainless ferritic-austenitic steel which overcomes the problems discussed above.

DISCLOSURE OF INVENTION

According to the invention a method of manufacturing stainless ferritic-austenitic steel containing up to 0.10 percent of C, up to 4.0 percent of Si, up to 2.0 percent of Mn, from 20 to 30 percent of Cr, from 3 to 8 percent of Ni, from 1.0 to 6.0 percent of Mo, up to 0.5 percent of V and up to 4.0 percent of Cu, the remainder being iron and unavoidable impurities in unimportant amounts, comprising the steps of preparing a melt of the steel with a nitrogen content higher than about 0.10 percent, preferably from about 0.15 to about 0.80 percent, and an austenite content not less than about 20 percent, preferably from about 20 percent to about 50 percent, gas atomizing said melt to form a powder, compacting said powder into a body, preferably employing an isostatic or semiisostatic compaction procedure, heat-treating said body at a temperature of from about 950° to about 1250° C., and cooling the heat-treated body in water, oil or air.

By the powder-metallurigical method according to the invention it has proved to be possible considerably to increase the alloying content of the SIS 2324 type steels and thus to achieve a high yield strength and/or very good corrosion resistance without being hampered by the above-mentioned difficulties such as crack formation during manufacture or unacceptable brittling phenomena. However, it is essential that a high-quality powder, i.e. powder manufactured by gas atomizing (utilizing for example nitrogen or argon), is used. An example of a suitable form of gas atomizing is described in published European patent application No. 0007536 (published February 6th, 1980). It is also essential that the powder be compacted into a completely dense material for the properties to be satisfactory. An example of a suitable form of isostatic or semiisostatic compaction for this purpose is described in published European patent application No. 0014975 (published September 3rd, 1980). Such isostatic or semiisostatic compaction may possibly be followed by forging.

To attain a particularly good resistance to intercrystalline corrosion, the steel is given a maximum carbon content of about 0.06 percent.

A particularly high yield strength may be attained by the use of a nitrogen content of from about 0.30 to 0.80 percent and an austenite content of from about 20 to about 40 percent. The yield strength may also be improved by aging at a temperature of from about 400° to about 500° C.

To illustrate the potential of the present invention, the following Examples may be mentioned.

EXAMPLE 1

During development work on stainless ferritic-austenitic steels, a steel was produced with a high yield strength (>600 N/mm$^2$) and very good corrosion resistance, better than, for example, steels according to Swedish Pat. No. 365821. However, the steel was sensitive to the formation of cracks during forging and exhibited too high a propensity to segregation to be utilized for forgings weighing more than about 100 kg manufactured by the previously used methods. Furthermore, the steel was difficult to work. Sawing was a particularly difficult problem, and this made it difficult to saw out blocks for forging. Brittling phenomena (brittling at 475° C.) also caused problems. This steel has now been manufactured by the powder metallurgical method according to the invention, with the good results mentioned above. For example, in a 1.6 tonnes high-frequency crucible furnace with a basic lining there was manufactured a steel melt containing 0.032 percent of C, 0.06 percent of Si, 0.44 percent of Mn, 0.019 percent of P, 0.010 percent of S, 27.5 percent of Cr, 4.7 percent of Ni, 2.8 percent of Mo, 0.15 percent of V and 0.30 percent of N, the remainder being iron and unavoidable impurities in unimportant amounts.

The steel melt was thereafter atomized with nitrogen gas in a horizontal gas atomizing plant. After separation of flakes and powder grains exceeding 1 mm, sheet capsules were filled with powder and were then welded together and evacuated. The sheet capsules were cylindrical with a diameter of 400 mm and a height of 200 mm, the powder weight being approximately 130 kg. The capsules were compacted into completely dense bodies by a semiisostatic compaction method according to the above-mentioned published European patent application No. 0014975. Thereafter, the compacted billets were drawn out into rings with an external diameter of approximately 700 mm. The forging was carried out without any problems whatsoever with crack formation, which would not have been possible with conventional, ingot-based manufacture. After forging, the rings were heat-treated (solution treatment and quenching from 1100° C.), which resulted in a product having the following properties measured using standard test pieces of the product:

| | |
|---|---|
| Limit of elasticity (LE) at 0.2 percent elongation | 640 N/mm$^2$ |
| Ultimate tensile strength (UTS) | 800 N/mm$^2$ |
| Percentage elongation (EL) measured over a length of $5.65 \times (A)^{\frac{1}{2}}$, where A is the cross-sectional area of the test piece | 30 |
| Percentage area reduction (AR) at fracture | 57 |
| Impact strength (IS) | 40 J. |

On testing in a boiling aqueous solution containing 3 percent of NaCl and 1 percent of AgCl, the steel exhibited a very good resistance to intercrystalline corrosion. The steel was now very fine-grained and exhibited almost isotropic properties. The hardness was extremely even. The material was completely free from segregation and less prone to become brittle than a conventional material of the same analysis. Turning and cutting operations involved no problems, but sawing was still difficult. However, the powder metallurgical manufacturing method according to the invention means that a capsule is manufactured by forging, and therefore no sawing of the block for forging is necessary, so the sawing properties are of minor interest.

EXAMPLE 2

Another very interesting steel produced during development work contained 0.07 percent of C, 0.57 percent of Si, 0.41 percent of Mn, 0.015 percent of P, 0.009 percent of S, 23.0 percent of Cr, 5.2 percent of Ni, 5.0 percent of Mo and 0.20 percent of N, the remainder being iron and unavoidable impurities in unimportant amounts.

When manufactured by a conventional ingot-based method, followed by solution treatment and quenching from 1100° C. in water, the following properties were obtained:

LE=640 N/mm$^2$, UTS=840 N/mm$^2$, EL=35, AR=50 and IS=40 J.

The steel had excellent corrosion properties in chloride-containing solutions, but was difficult to forge and very prone to segregations. However, when the same steel was manufactured by the powder metallurgical technique described in Example 1, these drawbacks were completely eliminated.

EXAMPLE 3

Another interesting steel obtained during development work contained 0.02 percent of C, 2.6 percent of Si, 0.68 percent of Mn, 0.010 percent of P, 0.014 percent of S, 23.3 percent of Cr, 6.4 percent of Ni, 2.8 percent of Mo and 0.15 percent of N, the remainder being iron and unavoidable impurities in unimportant amounts.

When manufactured by a conventional ingot-based method followed by solution treatment and quenching from 1025° C. in water, the following properties were obtained:

LE=620 N/mm$^2$, UTS=830 N/mm$^2$, EL=25 and IS=35 J.

This steel possessed excellent corrosion properties in chloride-containing solutions. However, it had a high propensity to segregation and brittleness. Cracks were formed in an ingot which cooled freely in air.

However, when the same steel was manufactured by the powder metallurgical technique described in Example 1, the propensity to segregation was completely eliminated and the propensity to brittling was reduced. The forging quality was also markedly improved.

Alloying of copper into the steel often results in a considerably reduced malleability when manufacturing products from ingots, owing to the existence of low-melting copper-rich segregation regions in the structure. By manufacture by a powder metallurgical method according to the invention, these problems can be completely eliminated since no segregations will then occur.

Alloying of nitrogen into ferritic-austenitic steel-especially when the structure remains constant (i.e. alloying of nitrogen followed by an increase in a ferrite-stabilizing element such as Si, Cr or Mo or by a decrease in an austenite-stabilizing element such as C, Ni or Mn)—results in a marked increase of the yield strength. According to investigations carried out, nitrogen has a yield strength-increasing effect up to nitrogen contents higher than those hitherto used in ferritic-austenitic steels, that is, in respect of nitrogen contents in excess of 0.20 percent also. However, the manufacture of such high-nitrogen steels involves considerable problems when manufacturing products from ingots. The problems include the occurrence of harmful segregations, the formation of porous material and, if the solution limit is exceeded, considerable difficulties in achieving forging without cracks arising, great difficulties in sawing and uneven properties. By using a powder metallurgical method according to the invention, these difficulties can be overcome. By working at an overpressure of nitrogen in the casting box and in the atomizing chamber, it is even possible to manufacture powder having a higher nitrogen content than the solubility limit (approximately 0.40 percent). Steels having much higher yield strengths (>750 N/mm$^2$) can therefore be produced.

As mentioned above, parts for separating machines operating in highly corrosive environments are suitable products to be manufactured from stainless steel obtained by the method according to the invention. The method according to the invention may be varied in many ways within the scope of the following claims.

What is claimed is:

1. A method of manufacturing stainless ferritic-austenitic steel containing up to 0.10 percent of C, up to 4.0 percent of Si, up to 2.0 percent of Mn, from 20 to 30 percent of Cr, from 3 to 8 percent of Ni, from 1.0 to 6.0 percent of Mo, up to 0.5 percent of V and up to 4.0 percent of Cu, the remainder being iron and unavoidable impurities in unimportant amounts comprising the steps of:

preparing a melt of the steel with a nitrogen content higher than about 0.10 percent and an austenite content not less than about 20 percent, gas atomizing said melt to form a powder, compacting said powder into a body, heat-treating said body at a temperature of from about 950° to about 1250° C., and cooling the heat-treated body in water, oil or air.

2. A method according to claim 1, wherein the steel is given a maximum carbon content of 0.06 percent to achieve an especially good resistance to intercrystalline corrosion.

3. A method according to claim 1, wherein the steel is given a nitrogen content of from about 0.30 to about 0.80 percent and an austenite content of from about 20 to about 40 percent to achieve a high yield strength.

4. A method according to any of claims 1 to 3, wherein in addition to said heat treatment, the steel is also aged at a temperature of from about 400° to about 500° C. to improve the yield strength.

5. A method according to any of claims 1 to 3, wherein the steel is given a nitrogen content higher than about 0.40 percent, and the production of said powder is performed with a nitrogen overpressure.

6. A method according to any of claims 1 to 3, wherein said powder is compacted by means of isostatic or semi-isostatic compaction.

* * * * *